US009928677B2

(12) United States Patent
Wang et al.

(10) Patent No.: US 9,928,677 B2
(45) Date of Patent: Mar. 27, 2018

(54) BANKNOTE RECOGNITION METHOD BASED ON SORTER DUST ACCUMULATION AND SORTER

(71) Applicant: GRG BANKING EQUIPMENT CO., LTD., Guangzhou, Guangdong (CN)

(72) Inventors: Yang Wang, Guangdong (CN); Tiancai Liang, Guangdong (CN)

(73) Assignee: GRG BANKING EQUIPMENT CO., LTD., Guangzhou, Guangdong (CN)

( * ) Notice: Subject to any disclaimer, the term of this patent is extended or adjusted under 35 U.S.C. 154(b) by 0 days.

(21) Appl. No.: 15/328,814

(22) PCT Filed: Aug. 24, 2015

(86) PCT No.: PCT/CN2015/087901
§ 371 (c)(1),
(2) Date: Jan. 24, 2017

(87) PCT Pub. No.: WO2016/037523
PCT Pub. Date: Mar. 17, 2016

(65) Prior Publication Data

US 2017/0213409 A1 Jul. 27, 2017

(30) Foreign Application Priority Data

Sep. 11, 2014 (CN) ..... 2014 1 0460813

(51) Int. Cl.
*G07F 7/04* (2006.01)
*G07D 7/12* (2016.01)
(Continued)

(52) U.S. Cl.
CPC ..... *G07D 7/122* (2013.01); *G07D 7/2008* (2013.01); *G07D 11/0018* (2013.01); *G07D 11/0084* (2013.01); *G07F 7/04* (2013.01)

(58) Field of Classification Search
CPC ... G07F 7/04; G07D 7/00; G07D 7/12; G07D 7/1205; G07D 7/2008; G07D 7/202;
(Continued)

(56) References Cited

U.S. PATENT DOCUMENTS 7,057,723 B2 * 6/2006 Klock ..... G01J 3/02 356/328
7,359,543 B2 * 4/2008 Tsuji ..... G07D 7/181 194/207
(Continued)

FOREIGN PATENT DOCUMENTS

CN 1551039 A 12/2004
CN 1685373 A 10/2005
(Continued)

OTHER PUBLICATIONS

International Search Report for PCT/CN2015/087901, dated Nov. 11, 2015, ISA/CN, (16 pages).
(Continued)

*Primary Examiner* — Mark J Beauchaine
(74) *Attorney, Agent, or Firm* — U.S. Fairsky LLP; Yue Xu

(57) ABSTRACT

A banknote recognition method based on sorter dust accumulation and a sorter. An effective region boundary is determined by using a gray-scale difference between a foreground and a background of a sensor image signal, an edge is searched for by comprehensive means of signal features of various sensors, detection direction change and secondary scanning, and finally the effective boundary of the image region is relocated, so that the detection rate and recognizing accuracy of the sorter can be greatly improved. The sorter comprises a banknote inlet, a banknote outlet, a banknote exit port, a conveying rail and a recognizing module. The recognizing module comprises two sets of CIS image sensors arranged oppositely, two sets of light trans-
(Continued)

mitting plates arranged oppositely, a storage module, a detection module and a display module.

8 Claims, 9 Drawing Sheets

(51) Int. Cl.
*G07D 11/00* (2006.01)
*G07D 7/20* (2016.01)

(58) Field of Classification Search
CPC ..... G07D 7/122; G07D 11/0018; G07D 11/0084; G06K 9/42; G06K 9/80; G06K 9/82
See application file for complete search history.

(56) References Cited

U.S. PATENT DOCUMENTS

| | | | | |
|---|---|---|---|---|
| 8,336,715 | B2 * | 12/2012 | Koga | G07D 11/0084 194/206 |
| 2004/0223147 | A1 * | 11/2004 | Fujimoto | G07D 7/12 356/239.1 |
| 2005/0244046 | A1 | 11/2005 | Yamamoto | |
| 2006/0233432 | A1 | 10/2006 | Ishida | |
| 2010/0102234 | A1 | 4/2010 | Hamasaki et al. | |
| 2010/0181162 | A1 | 7/2010 | Nagami | |
| 2010/0195918 | A1 | 8/2010 | Yonezawa et al. | |

FOREIGN PATENT DOCUMENTS

| | | | |
|---|---|---|---|
| CN | 1768356 | A | 5/2006 |
| CN | 101647046 | A | 2/2010 |
| CN | 101794476 | A | 8/2010 |
| CN | 101796550 | A | 8/2010 |
| CN | 103279735 | A | 9/2013 |
| CN | 103456075 | A | 12/2013 |
| CN | 103903329 | A | 7/2014 |
| CN | 104200566 | A | 12/2014 |
| EP | 2 187 359 | A1 | 5/2010 |
| JP | H02144383 | A | 6/1990 |
| JP | H06301784 | A | 10/1994 |
| JP | 2004280188 | A | 10/2004 |
| JP | 2004355264 | A | 12/2004 |
| JP | 2007179323 | A | 7/2007 |
| JP | 4334913 | B2 | 9/2009 |
| JP | 2011123301 | | 6/2011 |
| WO | 2014/005456 | A1 | 1/2014 |

OTHER PUBLICATIONS

Extended European Search Report dated Sep. 5, 2017, PCT/CN2015/087901 (8 pages) .

* cited by examiner

BANKNOTE RECOGNITION METHOD BASED ON SORTER DUST ACCUMULATION AND SORTER

The present application is the national phase of International Patent Application No. PCT/CN2015/087901, titled "BANKNOTE RECOGNITION METHOD BASED ON SORTER DUST ACCUMULATION AND SORTER", filed on Aug. 24, 2015, which claims the priority to Chinese Patent Application No. 201410460813.9, titled "BANKNOTE RECOGNITION METHOD BASED ON SORTER DUST ACCUMULATION AND SORTER", filed on Sep. 11, 2014 with the State Intellectual Property Office of the People's Republic of China, both of which are incorporated herein by reference in their entireties.

TECHNICAL FIELD

The present disclosure relates to the field of banknote recognition, and in particular to a banknote recognition method based on sorter dust accumulation and a sorter.

BACKGROUND

With the rapid development and application of electronic and computer technology, people tend to sort banknotes by using a financial instrument instead of a traditional manual operation, to meet requirements on efficiency and cost. A sorter is a kind of such financial instrument, which integrates technologies of computer and pattern recognition, to realize the authentication of banknotes, the multi-channel transmission of banknotes and other functions.

In operation, the sorter sorts the banknotes at a high speed, during which time friction is normally produced between the sorter and the banknotes, resulting in inks on the banknotes surface and adhesive matters attached during use falling off with mechanical movement. If the sorter is often used but not cleaned in time, the inks and the adhesive matters will be accumulated on both sides of a collecting module, resulting in abnormal image signal collected by the collecting module, and thus a low detection rate and low recognition accuracy of the sorter.

Generally, for an existing sorter, the above problem can only be solved by manually cleaning, which is cumbersome. Furthermore, a user does not know an appropriate time for cleaning, resulting in a poor user experience.

SUMMARY

The present disclosure provides a banknote recognition method based on sorter dust accumulation and a sorter. An effective region boundary is determined by using a gray difference between a foreground and a background of a sensor image signal, an edge is searched for by comprehensive means of signal features of various sensors, detection direction change and secondary scanning, and finally the effective boundary of the image region is relocated. Therefore, the detection rate and recognizing accuracy of a sorter can be greatly improved.

A banknote recognition method based on sorter dust accumulation is provided according to an embodiment of the present disclosure, which includes:

S1, collecting a reflection spectrum image and a transmission spectrum image of a banknote;

S2, positioning four edges of the reflection spectrum image and determining whether the four edges of the reflection spectrum image are positioned successfully, obtaining a positioned image and performing steps S3 and S4 if the four edges of the reflection spectrum image are positioned successfully, and performing step S5 if the four edges of the reflection spectrum image are not positioned successfully;

S3, performing angular rotation mapping on the positioned image, to obtain a positive image of the reflection spectrum image;

S4, determining whether the positive image of the reflection spectrum image is normal, performing step S7 if the positive image of the reflection spectrum image is normal, and performing step S5 if the positive image of the reflection spectrum image is not normal;

S5, positioning four edges of the transmission spectrum image, performing steps S6 and S7 if the four edges of the transmission spectrum image are positioned successfully, and performing step S8 if the four edges of the transmission spectrum image are not positioned successfully;

S6, mapping the four edges of the transmission spectrum image to the reflection spectrum image and performing angular rotation mapping, to obtain the positive image of the reflection spectrum image;

S7, recognizing the banknote; and

S8, returning the banknote.

Optionally, step S2 includes:

S21, positioning the four edges of the reflection spectrum image; and

S22, determining whether the four edges of the reflection spectrum image are positioned successfully, obtaining the positioned image and performing steps S3 and S4 if the four edges of the reflection spectrum image are positioned successfully, and performing step S5 if the four edges of the reflection spectrum image are not positioned successfully.

Optionally, the four edges include a left edge, a right edge, a upper edge and a lower edge, and step S21 includes:

searching from a left side of the reflection spectrum image, suspending the searching if the following criterion is met for a pixel point:

$$\begin{cases} notegray(i, j+1) - notegray(i, j) > \text{Threshold} \\ notegray(i, j+2) - notegray(i, j) > \text{Threshold} \end{cases},$$

$$(0 < i < H, 0 < j < 2/W),$$

marking coordinates of the pixel point, obtaining marked coordinates of a series of such pixel points, and performing straight-line fitting on the pixel points to complete positioning the left edge; and positioning the right edge, the upper edge and the lower edge in a same manner as positioning the left edge, where notegray(i, j) denotes a gray value of the pixel point in the i-th and the j-th column of the reflection spectrum image, H denotes a height of the reflection spectrum image, W denotes a width of the reflection spectrum image, and Threshold denotes an edge detection criterion threshold.

Optionally, step S22 includes:

determining that the four edges of the reflection spectrum image are positioned successfully, obtaining the positioned image and performing steps S3 and S4, if the following criterions are met for an image enclosed by the four edges:

$$\begin{cases} pixgray(i, j) < notegray(i, j) \\ notegray(i, j) - backgray(i, j) > \text{Threshold} \end{cases},$$

otherwise performing step S5, where notegray(i, j) denotes a gray value of a pixel at a position of a dust accumulation line, pixgray(i, j) denotes a gray value of a foreground of the banknote, backgray(i, j) denotes a gray value of a background of the banknote, and Threshold denotes an edge detection threshold.

Optionally, step S22 includes:

determining that the four edges of the reflection spectrum image are positioned successfully, obtaining the positioned image and performing steps S3 and S4 if the following criterions are met for an image enclosed by the four edges:

$$\begin{cases} pixgray(i, j) >= notegray(i, j) \\ notegray(i, j) - backgray(i, j) > \text{Threshold} \end{cases},$$

otherwise performing step S5, where notegray(i, j) denotes a gray value of a pixel at a position of a dust accumulation line, pixgray(i, j) denotes a gray value of a foreground of the banknote, backgray(i, j) denotes a gray value of a background of the banknote, and Threshold denotes an edge detection threshold.

Optionally, step S4 includes:

accumulating sum(j) ($0<j<1/5W$) each time when a pixel point of the positive image of the reflection spectrum image meets the following criterion:

notegray(i,W−j)−notegray(i, j)>Threshold($0<i<H, 0<j<1/5W$) or notegray(i, j)−notegray(i,W−j)>Threshold($0<i<H, 0<j<1/5W$);

determining that the positive image is a dust image and accumulating a statistical variable SUM if sum(j)>T; and determining that the positive image is an abnormal edge detection image and performing step S5 if SUM>$T_1$, otherwise performing step S7, where notegray(i, j) denotes a gray value of the pixel point in the i-th row and the j-th column of the reflection spectrum image, H denotes a height of the reflection spectrum image, W denotes a width of the reflection spectrum image, Threshold denotes a set threshold, T denotes a threshold of a number of dust accumulation points in a single column, and $T_1$ denotes a threshold of a number of dust accumulation columns.

Optionally, step S7 includes:

performing denomination recognition, orientation recognition, authenticity, and recognition for sorting function on the banknote.

An sorter is provided according to an embodiment of the present disclosure, which includes:

a collecting module, configured to collect a reflection spectrum image and a transmission spectrum image of a banknote;

a positioning and determining module, configured to position four edges of the reflection spectrum image and determine whether the four edges of the reflection spectrum image are positioned successfully;

a first rotation mapping module, configured to perform angular rotation mapping on a positioned image to obtain a positive image of the reflection spectrum image;

a second determining module, configured to determine whether the positive image of the reflection spectrum image is normal;

a positioning module, configured to position the four edges of the transmission spectrum image;

a second rotation mapping module, configured to map the four edges of the transmission spectrum image to the reflection spectrum image and performing angular rotation mapping to obtain the positive image of the reflection spectrum image;

a recognizing module, configured to recognize the banknote; and an returning module, configured to return the banknote.

A sorter is provided according to an embodiment of the present disclosure, which includes a banknote inlet, a banknote outlet, a banknote returning port, a conveying rail and a recognizing module, where the recognizing module includes two sets of CIS image sensors arranged opposite to two sets of light transmitting plates, a storage module, a detection module and a display module; where the two sets of CIS image sensors are arranged on two sides respectively;

the two sets of light transmitting plates are arranged on two sides respectively;

the CIS image sensors are configured to generate and receive a reflection spectrum image;

the CIS image sensors and the light transmitting plates are configured to cooperate to generate and receive a transmission spectrum image; and the storage module is configured to store the reflection spectrum image and the transmission spectrum image.

An effective region boundary is determined by using a gray difference between a foreground and a background of a sensor image signal, an edge is searched for by comprehensive means of signal features of various sensors, detection direction change and secondary scanning, and finally the effective boundary of the image region is relocated. Therefore, the detection rate and recognizing accuracy of a sorter can be greatly improved with the banknote recognition method based on sorter dust accumulation and the sorter according to the present disclosure.

DETAILED DESCRIPTION OF THE EMBODIMENTS

The present disclosure provides a banknote recognition method based on sorter dust accumulation and a sorter. An effective region boundary is determined by using a gray difference between a foreground and a background of a sensor image signal, an edge is searched for by comprehensive means of signal features of various sensors, detection direction change and secondary scanning, and finally the effective boundary of the image region is relocated. Therefore, the detection rate and recognizing accuracy of a sorter can be greatly improved.

It is noted that, the method according to the embodiments of the present disclosure can be applied to detect not only banknotes, but also checks and other sheet-like valuable magnetic documents. An apparatus according to the embodiments of the present disclosure can be applied to an ATM machine and bill processing equipment such as a sorter. Hereinafter, the method according to the embodiments of the present disclosure will be described with an example of a sorter. Although only the sorter is described as an example, it should not be construed as a limitation to the method in the present disclosure.

Figure 1:
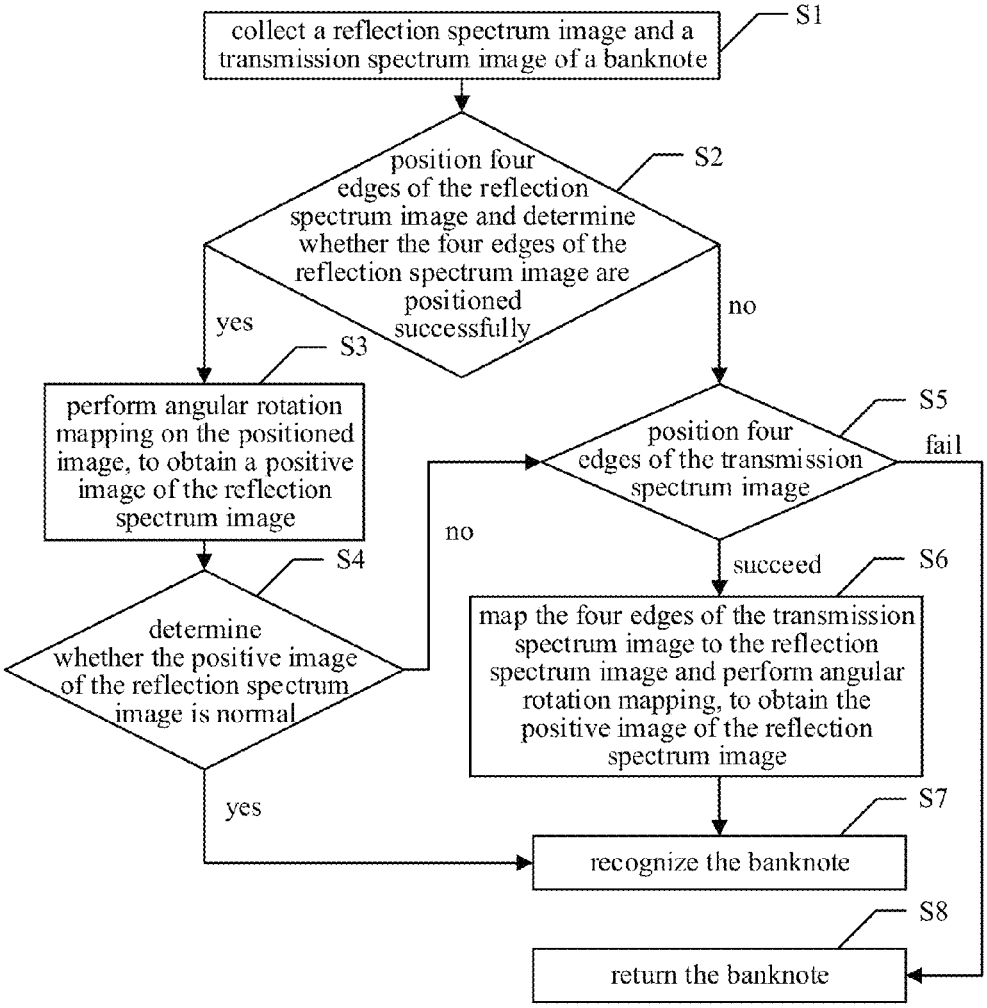
FIG. 1 is a flow chart of a banknote recognition method based on sorter dust accumulation according to a first embodiment of the present disclosure.

Referring to FIG. 1, a first embodiment of the banknote recognition method based on sorter dust accumulation includes the following steps S1 to S8.

In step S1, a reflection spectrum image and a transmission spectrum image of the banknote are collected.

Spectrum signals collected by a sensor of a sorter include white spectrum signals, reflection spectrum signals, transmission spectrum signals, ultraviolet signals, magnetic signals, thickness signals, and the like. In this disclosure, a banknote is detected and recognized by treating a reflection spectrum image and a transmission spectrum image of the banknote as target images, and thus the reflection spectrum image and the transmission spectrum image of the banknote are collected first.

In step S2, four edges of the reflection spectrum image are positioned and it is determined whether the four edges are positioned successfully. If the four edges are positioned successfully, a positioned image is obtained and steps S3 and S4 are performed, otherwise step S5 is performed.

After obtaining the reflection spectrum image of the banknote, the four edges of the reflection spectrum image are positioned, to determine the image area of the banknote. Steps S3 and S4 are performed if it is determined that the four edges are positioned successfully, otherwise step S5 is performed.

In step S3, angular rotation mapping is performed on the positioned image, to obtain a positive image of the reflection spectrum image.

If it is determined that the four edges of the reflection spectrum image are positioned successfully, the angular rotation mapping is performed on the positioned image to obtain the positive image of the above reflection spectrum image.

In step S4, it is determined whether the positive image of the reflection spectrum image is normal. If the positive image is normal, step S7 is performed, otherwise step S5 is performed.

After obtaining the positive image of the reflection spectrum image, it may be further determined whether the positive image of the reflection spectrum image is normal, that is, whether a spectrum image contained in the positive image is complete or out of range. And if the positive image is normal, step S7 is performed, otherwise step S5 is performed.

In step S5, four edges of the transmission spectrum image are positioned. If the four edges of the transmission spectrum image are positioned successfully, steps S6 and S7 are performed, otherwise step S8 is performed.

If the reflection spectrum image is not positioned successfully or the positive image of the reflection spectrum image is abnormal, the four edges of the transmission spectrum image may be positioned, so as to position the reflection spectrum image by positioning the transmission spectrum image. If the transmission spectrum image is positioned successfully, steps S6 and S7 are performed, otherwise step S8 is performed.

In step S6, the four edges of the transmission spectrum image are mapped to the reflection spectrum image and angular rotation mapping is performed, to obtain the positive image of the reflection spectrum image.

If it is determined that the transmission spectrum image is positioned successfully, the four edges of the transmission spectrum image may be mapped to the reflection spectrum image and angular rotation mapping is performed, to obtain the positive image of the reflection spectrum image.

In step S7, the banknote is recognized.

The banknote is recognized after the positive image of the reflection spectrum image is obtained in step S6 or after it is determined that the positive image of the reflection spectrum image is normal.

In step S8, the banknote is returned.

The banknote is returned if it is determined that the transmission spectrum image is not positioned successfully.

An effective region boundary is determined by using a gray difference between a foreground and a background of a sensor image signal, an edge is searched for by comprehensive means of signal features of various sensors, detection direction change and secondary scanning, and finally the effective boundary of the image region is relocated. Therefore, the detection rate and recognizing accuracy of a sorter can be greatly improved with the banknote recognition method based on sorter dust accumulation and the sorter according to the present disclosure.

Figure 2:
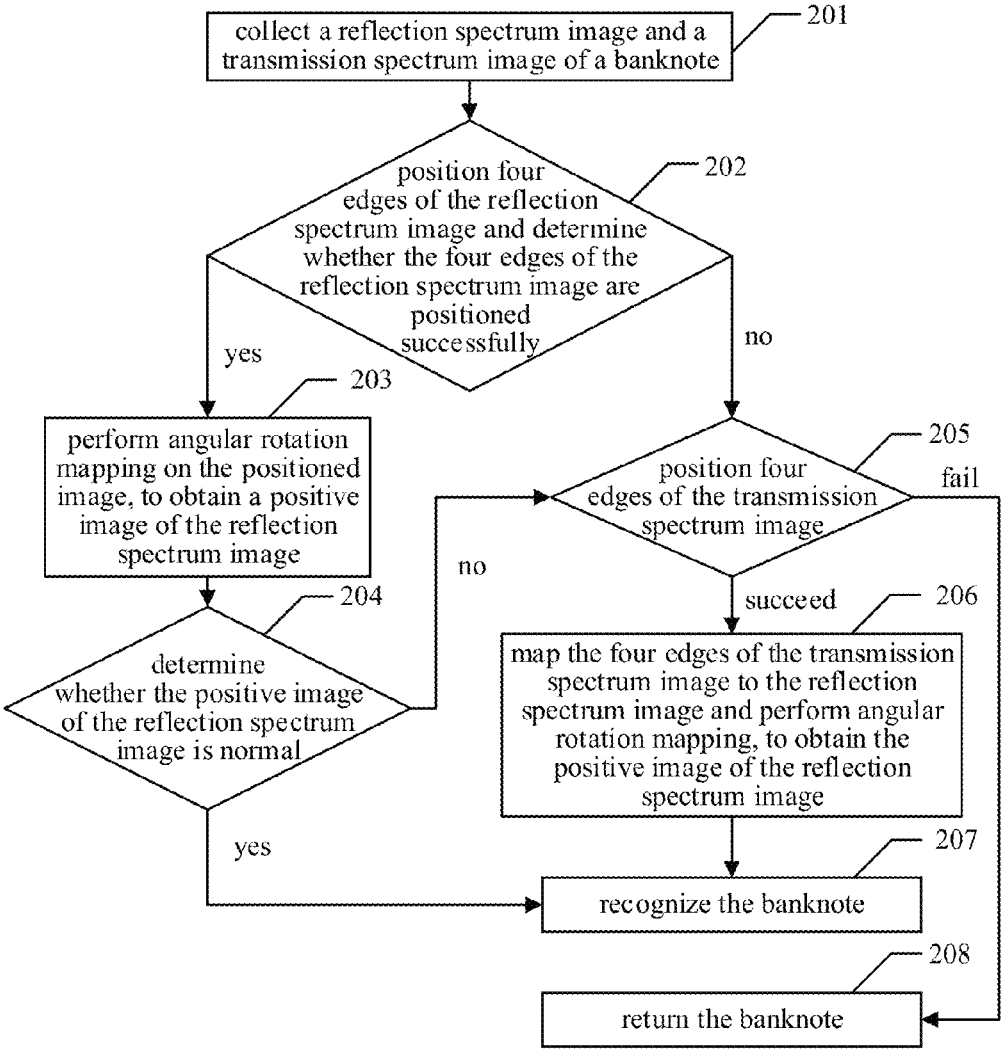
FIG. 2 is a flow chart of a banknote recognition method based on sorter dust accumulation according to a second embodiment of the present disclosure.
Figure 3:
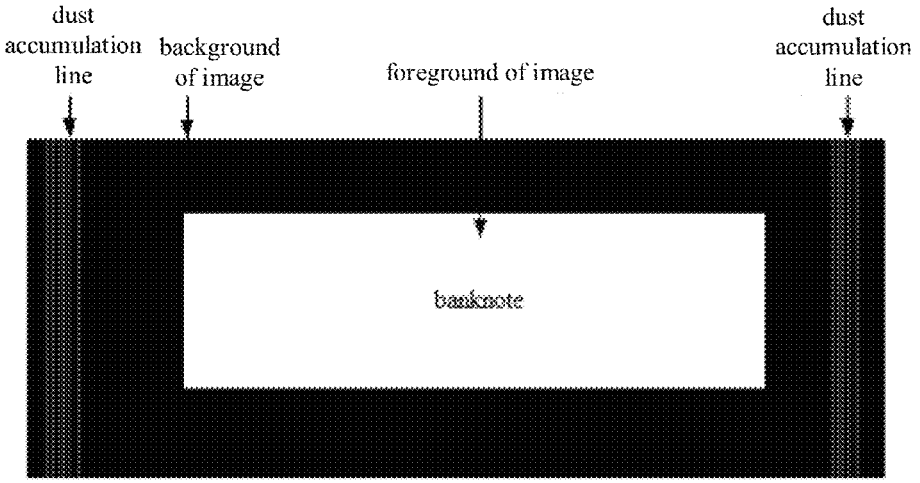
FIG. 3 shows a reflection spectrum image in a banknote recognition method based on sorter dust accumulation according to an embodiment of the present disclosure.
Figure 4:
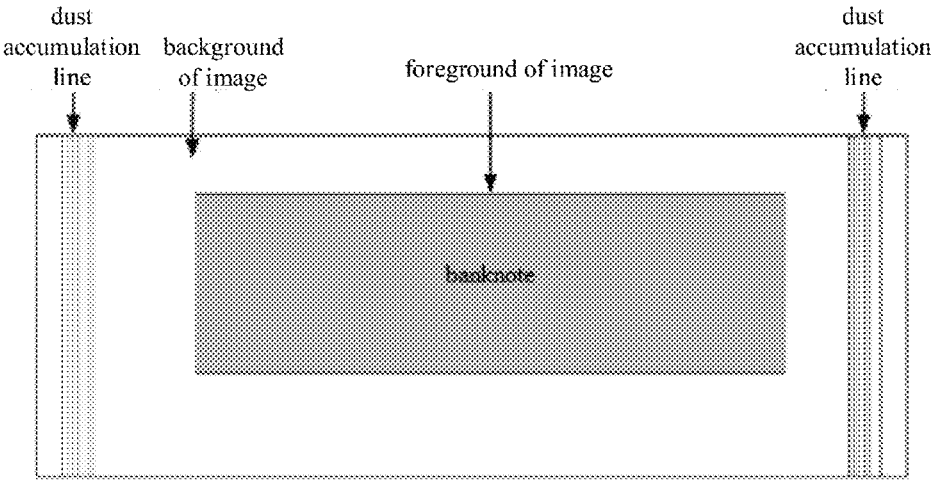
FIG. 4 shows a transmission spectrum image in a banknote recognition method based on sorter dust accumulation according to an embodiment of the present disclosure.

The first embodiment of the banknote recognition method based on sorter dust accumulation is briefly described above. Hereinafter, a second embodiment of the banknote recognition method based on sorter dust accumulation will be described in detail. Referring to FIG. 2, the second embodiment of the banknote recognition method based on sorter dust accumulation includes the following steps 201 to 208.

In step 201, the reflection spectrum image and the transmission spectrum image of the banknote are collected.

Spectrum signals collected by a sensor of a sorter include white spectrum signals, reflection spectrum signals, transmission spectrum signals, ultraviolet signals, magnetic signals, thickness signals, and the like. In this disclosure, a banknote is detected and recognized by treating a reflection spectrum image and a transmission spectrum image of the banknote as target images, and thus the reflection spectrum image and the transmission spectrum image of the banknote are collected first.

In step 202, the four edges of the reflection spectrum image are positioned and it is determined whether the four edges are positioned successfully. If the four edges are positioned successfully, the positioned image is obtained and steps 203 and 204 are performed, otherwise step 205 is performed.

Figure 5:
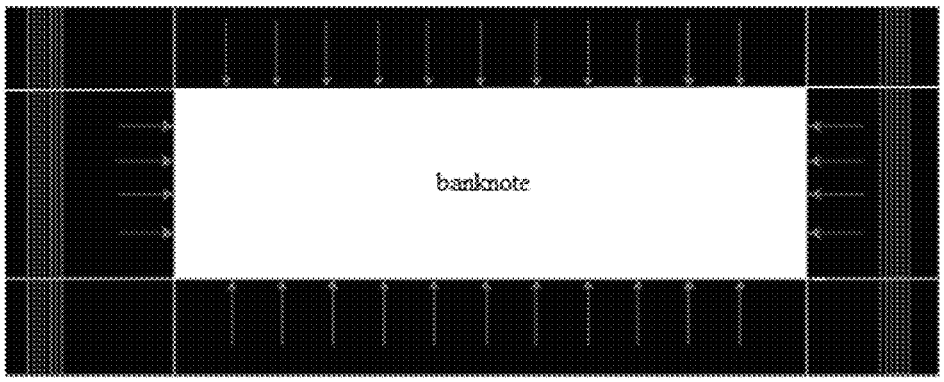
FIG. 5 is a schematic diagram of positioning a reflection spectrum image in the banknote recognition method based on sorter dust accumulation according to the second embodiment of the present disclosure.

After obtaining the reflection spectrum image of the banknote, the four edges of the reflection spectrum image are positioned, to determine the image area of the banknote. And steps 203 and 204 are performed if it is determined that the four edges are positioned successfully, otherwise step 205 is performed. Referring to FIG. 5, a boundary search is carried out from the upper, lower, left and right sides to the center of the reflection spectrum image, to position the four edges of the reflection spectrum image.

Step 202 may specifically include steps 2021 and 2022. In step 2021, it is determined whether the four edges of the reflection spectrum image are positioned successfully. If the four edges are positioned successfully, the positioned image is obtained and steps 203 and 204 are performed, otherwise step 205 is performed. In step 2022, angular rotation mapping is performed on the positioned image, to obtain the positive image of the reflection spectrum image.

Step 2021 may specifically include the following steps. The four edges include a left edge, a right edge, an upper edge and a lower edge. A search is performed from a left side of the reflection spectrum image. If the following criterion is met for a pixel point:

$$\begin{cases} notegray(i,\ j+1) - notegray(i,\ j) > \text{Threshold} \\ notegray(i,\ j+2) - notegray(i,\ j) > \text{Threshold} \end{cases},$$

$$(0 < i < H,\ 0 < j < 2/W),$$

the searching is suspended, coordinates of the pixel point is marked, marked coordinates of a series of such pixel points are obtained and straight-line fitting is performed on the pixel points to complete positioning of the left edge. The right edge, the upper edge and the lower edge are positioned in a same manner as positioning the left edge. In the criterion, notegray(i, j) denotes a gray value of the pixel point in the i-th row and the j-th column of the reflection spectrum image, H denotes a height of the reflection spectrum image, W denotes a width of the reflection spectrum image, and Threshold denotes an edge detection criterion threshold. The following criterions are used for positioning the right edge, the upper edge and the lower edge:

$$\begin{cases} notegray(i,\ j-1) - notegray(i,\ j) > \text{Threshold} \\ notegray(i,\ j-2) - notegray(i,\ j) > \text{Threshold} \end{cases}, \text{the right edge,}$$

$$\begin{cases} notegray(i+1,\ j) - notegray(i,\ j) > \text{Threshold} \\ notegray(i+2,\ j) - notegray(i,\ j) > \text{Threshold} \end{cases}, \text{the upper edge,}$$

$$\begin{cases} notegray(i-1,\ j) - notegray(i,\ j) > \text{Threshold} \\ notegray(i-2,\ j) - notegray(i,\ j) > \text{Threshold} \end{cases}, \text{the lower edge.}$$

It is noted that, there is no necessary sequence for positioning the four edges of the reflection spectrum image. Furthermore, in order to save search time, a search range of the reflection spectrum image in the above embodiment is only ½ of the width of the reflection spectrum image, which however is not limited herein.

Figure 6:
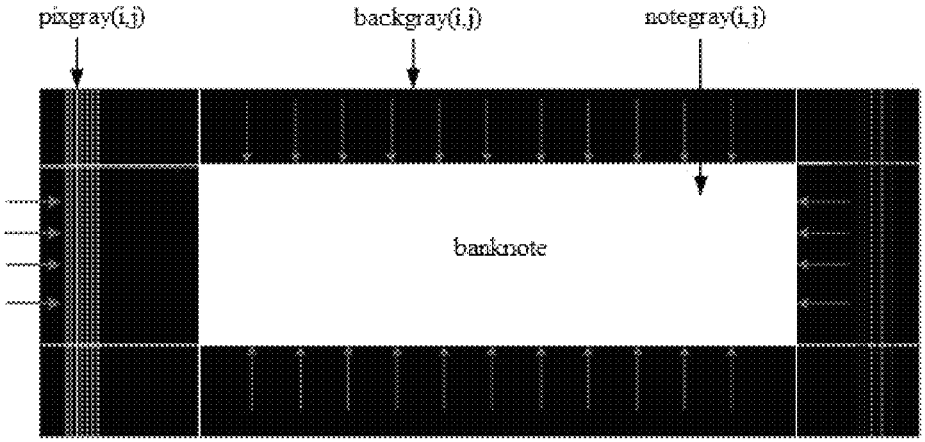
FIG. 6 is a schematic diagram showing that the positioning of the reflection spectrum image meets criterion 1 in the banknote recognition method based on sorter dust accumulation according to the second embodiment of the present disclosure.
Figure 7:
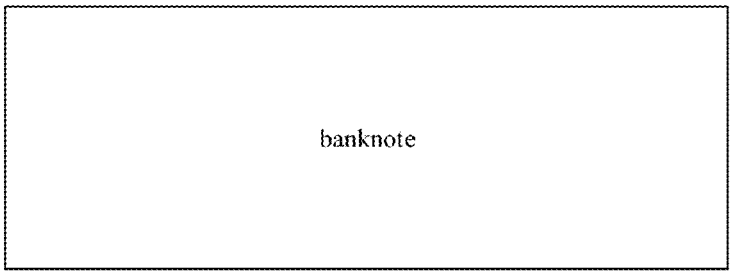
FIG. 7 is a schematic diagram of a positive image obtained after positioning successfully a reflection spectrum image in the banknote recognition method based on sorter dust accumulation according to the second embodiment of the present disclosure.

Referring to FIG. 6 or 7, step 2021 may specifically include the follow steps. If the following criterion is met for an image enclosed by the four edges:

$$\begin{cases} pixgray(i,\ j) < notegray(i,\ j) \\ notegray(i,\ j) - backgray(i,\ j) > \text{Threshold} \end{cases}, \text{criterion 1,}$$

it is determined that the four edges of the reflection spectrum image are positioned successfully, i.e., the gray values of the foreground and the background of the banknote meet the criterion, and the positioned image is obtained and steps 203 and 204 are performed, otherwise step 205 is performed. In the criterion, pixgray(i, j) denotes a gray value of a pixel at a position of a dust accumulation line, notegray(i, j) denotes a gray value of the foreground of the banknote, backgray(i, j) denotes a gray value of the background of the banknote, and Threshold denotes an edge detection threshold.

Figure 8:
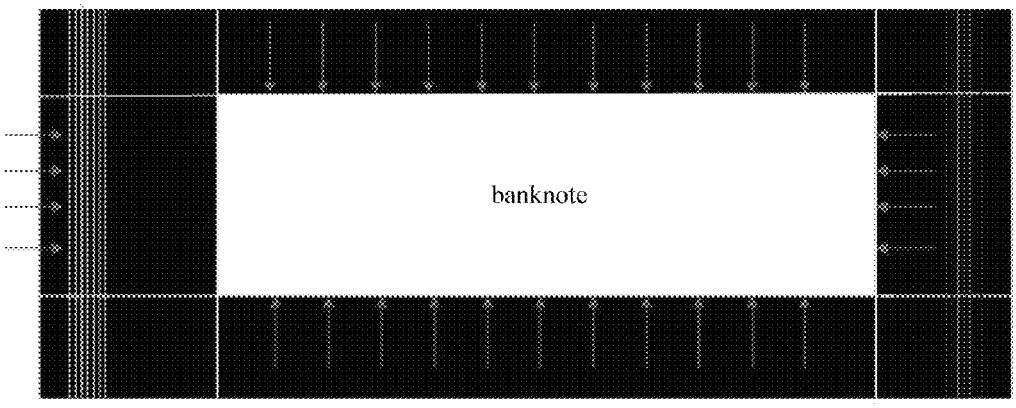
FIG. 8 is a schematic diagram showing that the positioning of the reflection spectrum image meets criterion 2 in the banknote recognition method based on sorter dust accumulation according to the second embodiment of the present disclosure.
Figure 9:
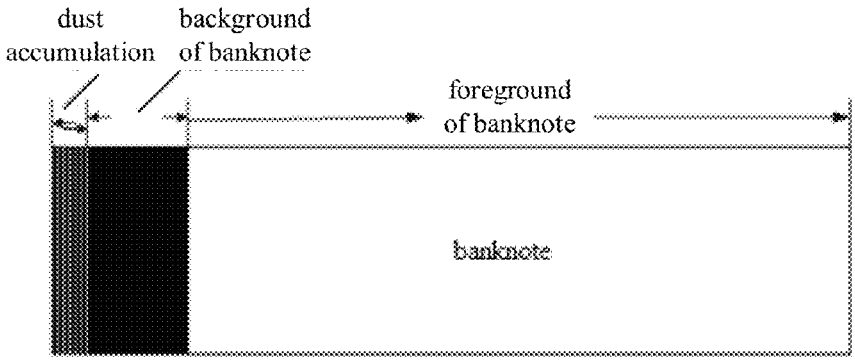
FIG. 9 is a schematic diagram showing that the positioning of the spectrum image fails in the banknote recognition method based on sorter dust accumulation according to the second embodiment of the present disclosure.

Referring to FIG. 8 or 9, step 2021 may specifically further include the follow steps. If the following criterion is met for an image enclosed by the four edges:

$$\begin{cases} pixgray(i,\ j) >= notegray(i,\ j) \\ notegray(i,\ j) - backgray(i,\ j) > \text{Threshold} \end{cases}, \text{criterion 2,}$$

it is determined that the four edges of the reflection spectrum image are positioned successfully, and the positioned image is obtained and steps 203 and 204 are performed, otherwise step 205 is performed. In the criterion, pixgray(i, j) denotes a gray value of a pixel at a position of a dust accumulation line, notegray(i, j) denotes a gray value of the foreground of the banknote, backgray(i, j) denotes a gray value of the background of the banknote, and Threshold denotes an edge detection threshold.

In step 204, it is determined whether the positive image of the reflection spectrum image is normal, and if the positive image is normal, step 207 is performed, otherwise step 205 is performed.

After obtaining the positive image of the reflection spectrum image, it may be further determined whether the positive image of the reflection spectrum image is normal, i.e., whether a spectrum image contained in the positive image is complete or out of range. If the positive image is normal, step 207 is performed, otherwise step 205 is performed.

If edges of a banknote are positioned successfully in a normal situation, a whole spectrum image of the foreground is extracted completely. In a case that an image is collected by a collecting module covered with a lot of dust such that, when searching edges, an edge of dust is mistakenly positioned as a left or right edge of the banknote, then the extracted spectrum image is partially a background image and partially a foreground image of the banknote. Therefore, a criterion is needed to judge the extracted spectrum image, to reduce a false recognition rate.

The determination of whether the positive image of the reflection spectrum image is normal may specifically include the following steps.

Each time when a pixel point of the positive image of the reflection spectrum image meets the criterion:

notegray(i,W−j)−notegray(i, j)>Threshold (0<i<H,0<j<1/5W) or notegray(i, j)−notegray(i,W−j)>Threshold (0<i<H,0<j<1/5W), sum(j) (0<j<1/5W) is accumulated.

If sum(j)>T, it is determined that the positive image is a dust image and a statistical variable SUM is accumulated.

If SUM>$T_1$, it is determined the positive image is an abnormal edge detection image and step S5 is performed, otherwise step S7 is performed. In the criterion, notegray(i, j) denotes a gray value of the pixel point in the i-th row and the j-th column of the reflection spectrum image, H denotes a height of the reflection spectrum image, W denotes a width of the reflection spectrum image, Threshold denotes a set threshold, T denotes a threshold of a number of dust accumulation points in a single column (if the banknote is an RMB banknote, T=¾H), and $T_1$ is a threshold of a number of dust accumulation columns (if the banknote is an RMB banknote, $T_1$=3).

In step 205, the four edges of the transmission spectrum image are positioned. If the four edges are positioned successfully, steps 206 and 207 are performed, otherwise step 208 is performed.

If the reflection spectrum image is not positioned successfully or the positive image of the reflection spectrum image is abnormal, the four edges of the transmission spectrum image are positioned, so as to position the reflection spectrum image by positioning the transmission spectrum image. If the transmission spectrum image is positioned successfully, steps 206 and 207 are performed, otherwise step 208 is performed.

Figure 10:
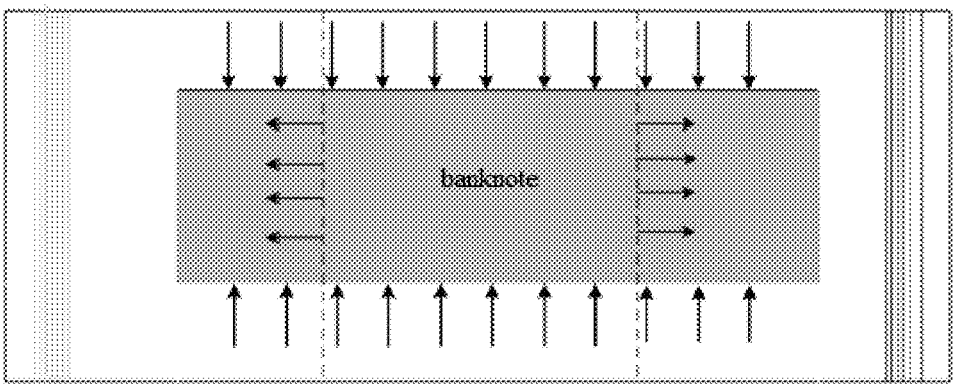
FIG. 10 is a schematic diagram of positioning a reflection spectrum image through positioning a transmission spectrum image in the banknote recognition method based on sorter dust accumulation according to the second embodiment of the present disclosure.
Figure 11:
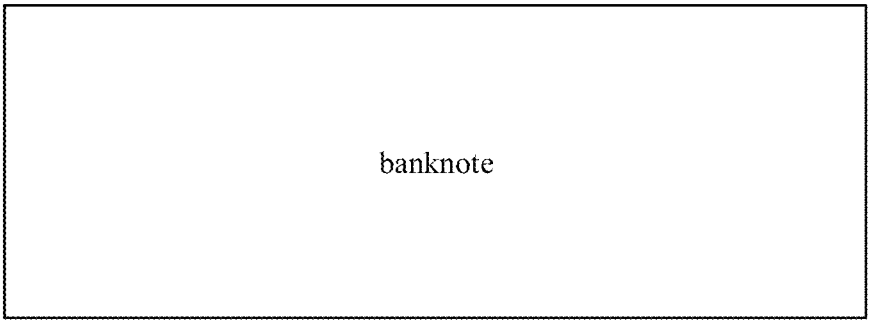
FIG. 11 is a schematic diagram of a positive image obtained after a reflection spectrum image is positioned successfully through positioning a transmission spectrum image in the banknote recognition method based on sorter dust accumulation according to the second embodiment of the present disclosure.

Referring to FIGS. 10 and 11, since features for banknote authentication may be reflected in the foreground image of the banknote obtained from the reflection spectrum image, which causes some interference to the edge search, the transmission spectrum image is used in the present disclosure, on which a reverse search for left and right is performed, to effectively avoid image interference caused by dust accumulation on the apparatus and features of the banknote. The point-to-point information mapping is adopted to map each edge point searched on the transmission spectrum image to the reflection spectrum image. In order to save search time, the search for the left and right edges are performed from a left third of the whole image to the left side, and from the right third of the whole image to the right side, while the search for the upper and lower edges remains unchanged. The positive image of the reflection spectrum image is obtained by performing mapping and angular rotation.

In step 206, the four edges of the transmission spectrum image are mapped to the reflection spectrum image and angular rotation mapping is performed, to obtain the positive image of the reflection spectrum image.

If it is determined that the transmission spectrum image is positioned successfully, the four edges of the transmission spectrum image are mapped to the reflection spectrum image and angular rotation mapping is performed, to obtain the positive image of the reflection spectrum image.

In step 207, the banknote is recognized.

The banknote is recognized after the positive image of the reflection spectrum image is obtained in step 206 or after it is determined that the positive image of the reflection spectrum image is normal.

The recognition of banknote may specifically include performing denomination recognition, orientation recognition, authentication, and recognition for sorting function on the banknote.

In step 208, the banknote is returned.

If it is determined that the transmission spectrum image is not positioned successfully, the banknote is returned.

An effective region boundary is determined by using a gray difference between a foreground and a background of a sensor image signal, an edge is searched for by comprehensive means of signal features of various sensors, detection direction change and secondary scanning, and finally the effective boundary of the image region is relocated. Therefore, the detection rate and recognizing accuracy of a sorter can be greatly improved with the banknote recognition method based on sorter dust accumulation and the sorter according to the present disclosure.

Figure 12:
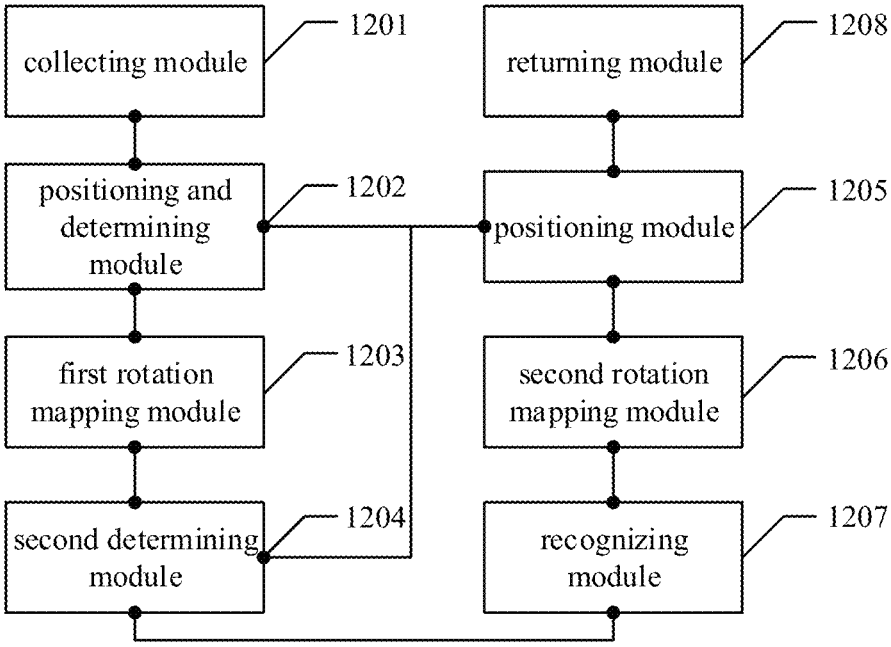
FIG. 12 is a schematic structural diagram of a sorter according to a first embodiment of the present disclosure.

The second embodiment of the banknote recognition method based on sorter dust accumulation is briefly described above. Hereinafter, a first embodiment of the sorter will be described in detail. Referring to FIG. 12, the first embodiment of the sorter includes: a collecting module 1201, a positioning and determining module 1202, a first rotation mapping module 1203, a second determining module 1204, a positioning module 1205, a second rotation mapping module 1206, a recognizing module 1207 and a returning module 1208.

The collecting module 1201 is configured to collect a reflection spectrum image and a transmission spectrum image of the banknote.

The positioning and determining module 1202 is configured to position four edges of the reflection spectrum image and determine whether the four edges of the reflection spectrum image are positioned successfully.

The first rotation mapping module 1203 is configured to perform angular rotation mapping on the positioned image to obtain a positive image of the reflection spectrum image.

The second determining module 1204 is configured to determine whether the positive image of the reflection spectrum image is normal.

The positioning module 1205 is configured to position four edges of the transmission spectrum image.

The second rotation mapping module 1206 is configured to map the four edges of the transmission spectrum image to the reflection spectrum image and perform angular rotation mapping to obtain the positive image of the reflection spectrum image.

The recognizing module 1207 is configured to recognize the banknote.

The returning module 1208 is configured to return the banknote.

The first embodiment of the sorter corresponds to the first embodiment and the second embodiment of the banknote recognition method based on sorter dust accumulation, thus having the features of the first embodiment and second embodiment of the banknote recognition method based on sorter dust accumulation, which are not repeated herein.

Figure 13:
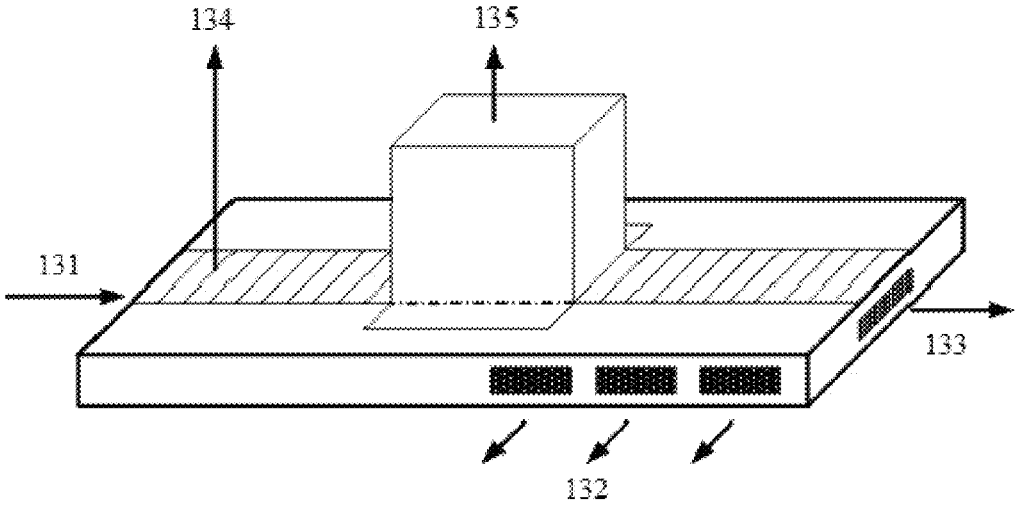
FIG. 13 is a schematic structural diagram of a sorter according to a second embodiment of the present disclosure.

The first embodiment of the sorter is briefly described above. Hereinafter, a second embodiment of the sorter will be described in detail. Referring to FIG. 13, the second embodiment of the sorter includes: a banknote inlet 131, a banknote outlet 132, a banknote returning port 133, a conveying rail 134 and a recognizing module 135. The recognizing module 135 includes: two sets of CIS image sensors 1351 arranged opposite to two sets of light transmitting plates 1352, a storage module, a detection module and a display module.

The two sets of CIS image sensors 1351 are arranged on two sides respectively.

The two sets of light transmitting plates 1352 are arranged on two sides respectively.

The CIS image sensors 1351 are configured to generate and receive the reflection spectrum image.

The CIS image sensors 1351 and the light transmitting plates 1352 are configured to cooperate to generate and receive the transmission spectrum image.

The storage module is configured to store the reflection spectrum image and the transmission spectrum image.

Reference is made to FIG. 13, which is a schematic structural diagram of a sorter according to the present disclosure. The workflow of the sorter is described below. A banknote is driven by a mechanical device into the recognizing module 135. Image scanning is carried out by the recognizing module 135 and the acquired image is sent to the storage. The image in the storage is detected and recognized by a recognition algorithm. And finally a recognition result is sent to a host computer to control the banknote to be sent out via a port.

Figure 14:
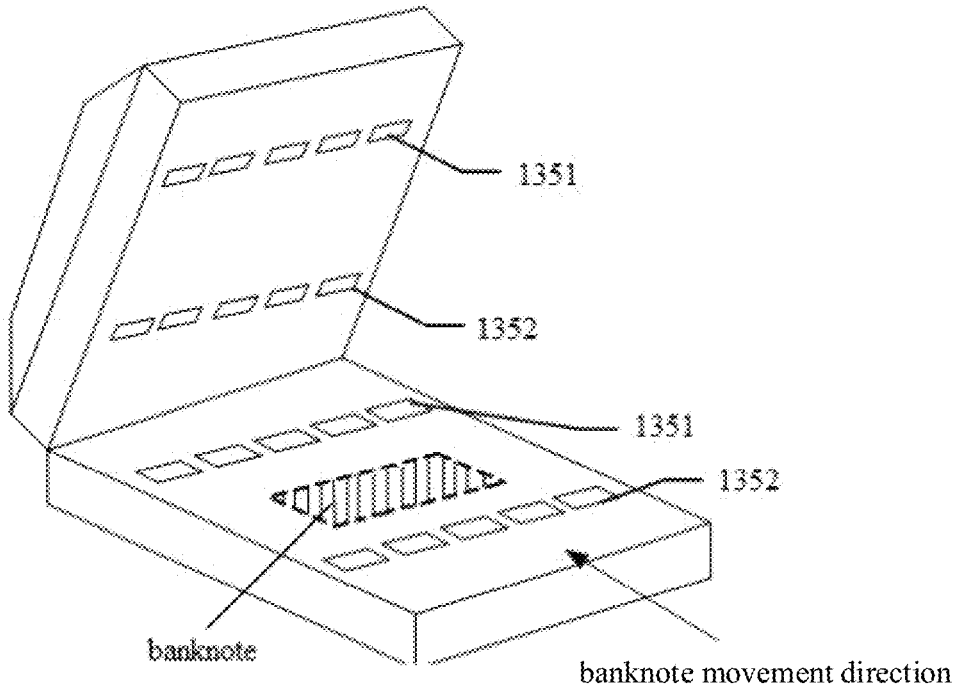
FIG. 14 is a schematic structural diagram of a recognizing module of a sorter according to a second embodiment of the present disclosure.

Referring to FIG. 14, when a banknote passes through the CIS image sensor 1351, a light emitted from an internal LED light source array of the CIS image sensor irradiates the surface of the banknote, then the light reflected from the surface of the banknote is focused by a self-focusing rod lens array to image on a photoelectric sensor array and is converted into charges for storing. Light intensities at different parts of a scanned surface are different, and thus the light intensities received by sensor units (i.e., pixels of the CIS) at different positions are not the same. Upon reaching an accumulate time, a shift register controls analog switches to be sequentially turned on to output electric signals of the pixels sequentially in a form of analog signals, thereby obtaining light reflection image signals by scanning the banknote. The light transmitting plate 1352 is arranged directly opposite to the CIS image sensor 1351. After the reflection signals of the banknote image are received completely, a light source array of the light transmitting plate 1352 emits a light, which passes through the banknote and is received by the CIS image sensor 1351. After the above steps, a transmission spectrum signal is finally generated and outputted in form of analog signals. The whole process is instantaneous, taking about a few tens of microseconds. The reflection spectrum image and the transmission spectrum image are almost simultaneously received, in which pixel points are in one-to-one correspondence. By performing the secondary search detection with signal characteristics of the transmission spectrum image and mapping to the reflection spectrum image, the influence of the boundary dust accumulation can be solved effectively. Furthermore, each apparatus are provided with two stages of CIS image sensors 1351 and light transmitting plates 1352, in order to scan the frontal side and back side of the banknote, to improve the recognition efficiency.

An effective region boundary is determined by using a gray difference between a foreground and a background of a sensor image signal, an edge is searched for by comprehensive means of signal features of various sensors, detection direction change and secondary scanning, and finally the effective boundary of the image region is relocated. Therefore, the detection rate and recognizing accuracy of a sorter can be greatly improved with the banknote recognition method based on sorter dust accumulation and the sorter according to the present disclosure.

It can be understood by those skilled in the art that all or some of steps in the methods according to the above embodiments may be implemented by a program instructing hardware. The program may be stored in a computer-readable storage medium, which may be a read-only memory, a magnetic disk or an optical disk.

In the above, the banknote recognition method based on sorter dust accumulation and the sorter according to the present disclosure are described in detail. Variations can be made to the embodiments and the application scope by those skilled in the art based on the idea in the present disclosure. In summary, the content of the specification can be not interpreted as limitation to the invention.

The invention claimed is:

1. A banknote recognition method based on sorter dust accumulation, comprising:

S1, collecting, by a collecting module, a reflection spectrum image and a transmission spectrum image of a banknote;

S2, positioning, by a positioning and determining module, four edges of the reflection spectrum image and determining whether the four edges of the reflection spectrum image are positioned successfully, obtaining a positioned image and performing steps S3 and S4 if the four edges of the reflection spectrum image are positioned successfully, and performing step S5 if the four edges of the reflection spectrum image are not positioned successfully;

S3, performing, by a first rotation mapping module, angular rotation mapping on the positioned image, to obtain a positive image of the reflection spectrum image;

S4, determining, by a second determining module, whether the positive image of the reflection spectrum image is normal, performing step S7 if the positive image of the reflection spectrum image is normal, and performing step S5 if the positive image of the reflection spectrum image is not normal;

S5, positioning, by a positioning module, four edges of the transmission spectrum image, performing steps S6 and S7 if the four edges of the transmission spectrum image are positioned successfully, and performing step S8 if the four edges of the transmission spectrum image are not positioned successfully;

S6, mapping, by a second rotation mapping module, the four edges of the transmission spectrum image to the reflection spectrum image and performing angular rotation mapping, to obtain the positive image of the reflection spectrum image;

S7, recognizing, by a recognizing module, the banknote; and

S8, returning, by a returning module, the banknote.

2. The banknote recognition method based on sorter dust accumulation according to claim 1, wherein step S4 comprises:

accumulating sum(j) ($0<j<1/5W$) each time when a pixel point of the positive image of the reflection spectrum image meets the following criterion:

$\text{notegray}(i,W-j)-\text{notegray}(i,j)>\text{Threshold}(0<i<H,0<j<1/5W)$, or notegray(i, j)−notegray(i,W−j)>Threshold(0<i<H,0<j<1/5W);

determining that the positive image is a dust image and accumulating a statistical variable SUM if sum(j)>T; and determining that the positive image is an abnormal edge detection image and performing step S5 if SUM>$T_1$, otherwise performing step S7, wherein notegray(i, j) denotes a gray value of the pixel point in the i-th row and the j-th column of the reflection spectrum image, H denotes a height of the reflection spectrum image, W denotes a width of the reflection spectrum image, Threshold denotes a set threshold, T denotes a threshold of a number of dust accumulation points in a single column, and $T_1$ denotes a threshold of a number of dust accumulation columns.

3. The banknote recognition method based on sorter dust accumulation according to claim 1, wherein step S7 comprises performing denomination recognition, orientation recognition, authentication, and recognition for sorting function on the banknote.

4. The banknote recognition method based on sorter dust accumulation according to claim 1, wherein step S2 comprises:

S21, positioning the four edges of the reflection spectrum image; and

S22, determining whether the four edges of the reflection spectrum image are positioned successfully, obtaining the positioned image and performing steps S3 and S4 if the four edges of the reflection spectrum image are positioned successfully, and performing step S5 if the four edges of the reflection spectrum image are not positioned successfully.

5. The banknote recognition method based on sorter dust accumulation according to claim 4, wherein the four edges comprises a left edge, a right edge, an upper edge and a lower edge, and step S21 comprises:

searching from a left side of the reflection spectrum image, suspending the searching if the following criterion is met for a pixel point:

$$\begin{cases} notegray(i, j+1) - notegray(i, j) > \text{Threshold} \\ notegray(i, j+2) - notegray(i, j) > \text{Threshold} \end{cases},$$

$$(0 < i < H, 0 < j < 1/2W),$$

marking coordinates of the pixel point, obtaining marked coordinates of a series of such pixel points and performing straight-line fitting on the pixel points to complete positioning the left edge; and positioning the right edge, the upper edge and the lower edge in a same manner as positioning the left edge, wherein notegray(i, j) denotes a gray value of the pixel point in the i-th row and the j-th column of the reflection spectrum image, H denotes a height of the reflection spectrum image, W denotes a width of the reflection spectrum image, and Threshold denotes an edge detection criterion threshold.

6. The banknote recognition method based on sorter dust accumulation according to claim 4, wherein step S22 comprises:

determining that the four edges of the reflection spectrum image are positioned successfully, obtaining the positioned image and performing steps S3 and S4 if the following criterions are met for an image enclosed by the four edges:

$$\begin{cases} pixgray(i, j) >= notegray(i, j) \\ notegray(i, j) - backgray(i, j) > \text{Threshold} \end{cases},$$

otherwise performing step S5, wherein pixgray(i, j) denotes a gray value of a pixel at a position of a dust accumulation line, notegray(i, j) denotes a gray value of a foreground of the banknote, backgray(i, j) denotes a gray value of a background of the banknote, and Threshold denotes an edge detection threshold.

7. The banknote recognition method based on sorter dust accumulation according to claim 4, wherein step S22 comprises:

determining that the four edges of the reflection spectrum image are positioned successfully, obtaining the positioned image and performing steps S3 and S4 if the following criterion is met for an image enclosed by the four edges:

$$\begin{cases} notegray(i, j+1) - notegray(i, j) > \text{Threshold} \\ notegray(i, j+2) - notegray(i, j) > \text{Threshold} \end{cases},$$

$$(0 < i < H, 0 < j < 2/W),$$

otherwise performing step S5, wherein pixgray(i, j) denotes a gray value of a pixel at a position of a dust accumulation line, notegray(i, j) denotes a gray value of a foreground of the banknote, backgray(i, j) denotes a gray value of a background of the banknote, and Threshold denotes an edge detection threshold.

8. A sorter, comprising:

a collecting module, configured to collect a reflection spectrum image and a transmission spectrum image of a banknote;

a positioning and determining module, configured to position four edges of the reflection spectrum image and determine whether the four edges of the reflection spectrum image are positioned successfully, and obtain a positioned image if the four edges of the reflection spectrum image are positioned successfully;

a first rotation mapping module, configured to perform angular rotation mapping on the positioned image to obtain a positive image of the reflection spectrum image;

a second determining module, configured to determine whether the positive image of the reflection spectrum image is normal;

a positioning module, configured to position four edges of the transmission spectrum image;

a second rotation mapping module, configured to map the four edges of the transmission spectrum image to the reflection spectrum image and perform angular rotation mapping to obtain the positive image of the reflection spectrum image;

a recognizing module, configured to recognize the banknote; and a returning module, configured to return the banknote.

* * * * *